US007260957B2

(12) United States Patent
Kalyanavaradhan et al.

(10) Patent No.: US 7,260,957 B2
(45) Date of Patent: Aug. 28, 2007

(54) DAMPER FOR REFRIGERATION APPARATUS

(75) Inventors: Vijayan Kalyanavaradhan, Tamil Nadu (IN); Maheesh Natarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 68 days.

(21) Appl. No.: 11/297,251

(22) Filed: Dec. 8, 2005

(65) Prior Publication Data

US 2007/0130985 A1 Jun. 14, 2007

(51) Int. Cl.
*F25D 17/04* (2006.01)

(52) U.S. Cl. ..... 62/407

(58) Field of Classification Search ..... 62/131, 62/407, 408, 410, 412, 414, 441
See application file for complete search history.

(56) References Cited

U.S. PATENT DOCUMENTS 3,630,046 A * 12/1971 Boor ..... 62/408
4,843,831 A * 7/1989 Yamada ..... 62/155
4,843,833 A * 7/1989 Polkinghorne ..... 62/180
4,879,878 A * 11/1989 Polkinghorne ..... 62/187
5,642,628 A 7/1997 Whipple, III et al.
5,876,014 A 3/1999 Noritake et al.
6,336,339 B1 1/2002 Joung et al.
6,405,548 B1 6/2002 Hollenbeck
6,539,729 B2 4/2003 Tupis et al.
6,557,362 B1 5/2003 Wilson
6,722,144 B2 4/2004 Johnson
6,802,369 B2 10/2004 Zentner et al.

* cited by examiner

*Primary Examiner*—Melvin Jones
(74) *Attorney, Agent, or Firm*—George L. Rideout, Esq.; Armstrong Teasdale LLP

(57) ABSTRACT

A damper for controlling air flow into at least one refrigeration compartment of a refrigerator is provided. The damper includes a damper, and a first damper door and a second damper door movably mounted on the frame. The damper frame defines a first gate, a second gate, and a third gate thereon. The first door is positionable to selectively close at least one of the first gate and the third gate, and the second door is positionable to selectively close at least one of the second gate and the third gate. One of the first gate and the second gate facilitates flowing cool air into the refrigeration compartment when the first gate or the second gate is open. The third gate facilitates air circulation within the refrigeration compartment when the third gate is open.

20 Claims, 3 Drawing Sheets

DAMPER FOR REFRIGERATION APPARATUS

BACKGROUND OF THE INVENTION

This invention relates generally to dampers for controlling air flow, and, more particularly, to dampers for controlling air flow within refrigerators.

Conventionally, multi-compartment refrigerators include a fresh food compartment and a freezer compartment for chilling and preserving food items at respective desired temperatures. Typically, the fresh food compartment is set to a user adjustable setting and is thermostatically controlled to energize a refrigeration circuit (i.e., evaporator, condenser, etc.) to generate cooled air for introduction into the fresh food compartment. When the refrigeration circuit is energized, evaporator air is also introduced into the freezer compartment, and the temperature of the freezer compartment is controlled according to a user adjustable damper located in a flow path between the fresh food compartment and the freezer compartment. When the damper is fully closed, air flow from the freezer compartment into the fresh food compartment is substantially prevented, thereby maintaining the cooled evaporator air in the freezer compartment and lowering the freezer compartment temperature. When the damper is fully open, an appreciable amount of air from the freezer compartment flows into the fresh food compartment, thereby increasing the temperature of the freezer compartment.

Typically, the damper is a pivoting plate or baffle located in a flow path, and the plate pivots about an axis in the plane of the plate to obstruct or permit air flow through the flow path. As such, each damper is dedicated to a flow path, and a plurality of dedicated dampers is needed for different air flow paths. The plurality of dedicated dampers undesirably increases the quantity of parts needed, and complicates the mechanical configuration within the refrigerator.

BRIEF DESCRIPTION OF THE INVENTION

In one aspect, a damper for controlling air flow into at least one refrigeration compartment of a refrigerator is provided. The damper includes a damper, and a first damper door and a second damper door movably mounted on the frame. The damper frame defines a first gate, a second gate, and a third gate thereon. The first door is positionable to selectively close at least one of the first gate and the third gate, and the second door is positionable to selectively close at least one of the second gate and the third gate. One of the first gate and the second gate facilitates flowing cool air into the refrigeration compartment when the first gate or the second gate is open. The third gate facilitates air circulation within the refrigeration compartment when the third gate is open.

In another aspect, a refrigerator is provided including at least one refrigeration compartment and a damper. The damper includes a damper frame, and a first damper door and a second damper door movably mounted on the frame. The damper frame defines a first gate, a second gate, and a third gate thereon. A first damper door and a second damper door are movably mounted on the frame. The first door is positionable to selectively close at least one of the first gate and the third gate, and the second door is positionable to selectively close at least one of the second gate and the third gate. One of the first or second gate facilitates flowing cool air into the refrigeration compartment when one of the first gate and the second gate is open. The third gate facilitates air circulation within the refrigeration compartment when the third gate is open.

In still another aspect, a method for assembling a refrigerator is provided. The method includes providing a refrigeration compartment within the refrigerator, and providing a damper and coupling the damper with the refrigeration compartment. The method also includes providing a damper frame defining a first gate, a second gate, and a third gate thereon, one of the first and second gate is configured to allow cool air flowing into the refrigeration compartment when the one of the first and second gate is open, and the third gate is configured to allow air circulation within the refrigeration compartment when the third gate is open. The method also includes providing a first damper door and a second damper door movably mounted on the frame, the first door positionable to selectively close at least one of the first gate and the third gate, the second door positionable to selectively close at least one of the second gate and the third gate.

DETAILED DESCRIPTION OF THE INVENTION

Figure 1:
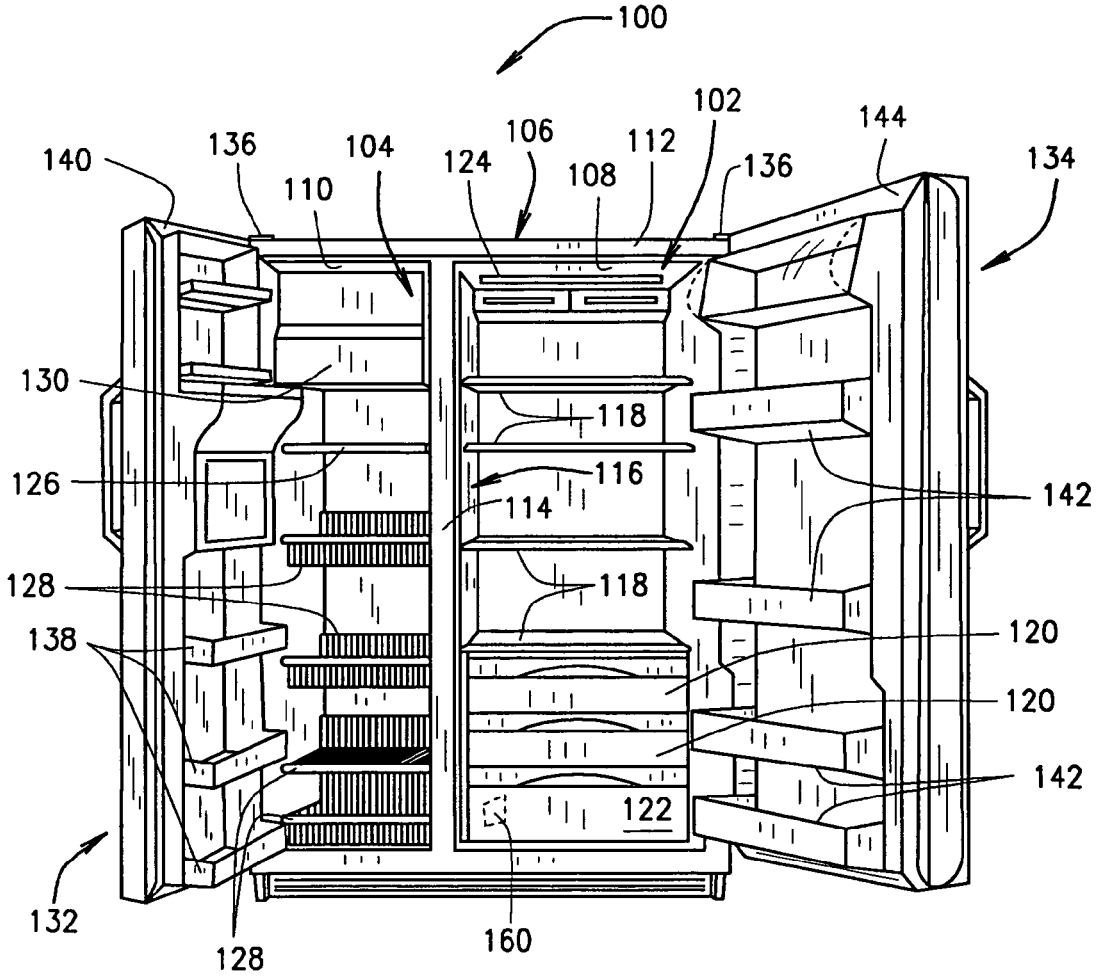
FIG. 1 perspective view of an exemplary refrigerator applicable to the present invention.

FIG. 1 illustrates an exemplary side-by-side refrigerator 100 in which the invention may be practiced. It is contemplated, however, that the teaching of the description set forth below is applicable to other types of refrigeration appliances, including but not limited to top and bottom mount refrigerators wherein undesirable temperature gradients exist. The present invention is therefore not intended to be limited to any particular type or configuration of a refrigerator, such as refrigerator 100.

Refrigerator 100 includes a fresh food storage compartment 102 and freezer storage compartment 104, an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which is also commonly referred to as a mullion 114. Mullion 114 is formed, in one embodiment, from an extruded ABS material. It will be understood that in a refrigerator with separate mullion dividing a unitary liner into a freezer and a fresh food compartment, a front face member of the mullion corresponds to mullion 114. Breaker strip 112 and mullion 114 form a front face, and extend completely around inner peripheral edges of case 106 and vertically between liners 108, 110. Mullion 114, the insulation between the compartments, and a spaced wall of liners separating the compartments, sometimes are collectively referred to herein as a center mullion wall 116.

Shelves 118 and slide-out drawers 120, 121 normally are provided in fresh food compartment 102 to support items being stored therein. A bottom drawer or pan 122 partly forms a quick chill and thaw system (not shown in FIG. 1) selectively controlled, together with other refrigerator features, by a microprocessor (not shown) according to user preference via manipulation of a control interface 124 mounted in an upper region of fresh food storage compartment 102 and coupled to the microprocessor. Shelves 126 and wire baskets 128 are also provided in freezer compartment 104. In some embodiments, an ice maker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

An air flow damper 160 is mounted on an opening (not shown) of center million wall 116, and positioned between freezer compartment 104 and pan 122. Damper 160 is coupled with at least one air passage (not shown in FIG. 13 in flow communication with pan 122, and may be operatively coupled with the microprocessor (not shown) of refrigerator 100. As such, the microprocessor may control damper 160 to allow cool air flowing from freezer compartment 104 into pan 122 in a chill mode, and may also control damper 160 to create an inner air circulation of pan 122 in a thaw mode. It is contemplated, however, that damper 160 may be applied to control the airflow of fresh food compartment 102 or other refrigeration compartments in alternative embodiments. In another embodiment, damper 160 is positioned within freezer compartment 104 and controls airflow within freezer compartment 104, such as within a pan (not shown) in freezer compartment 104.

In accordance with known refrigerators, known refrigeration components are at least partially maintained in a machinery compartment (not shown) located at a rear of refrigerator 100 for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments as desired. The frequency of refrigeration cycles may be varied with adjustment of damper 160, which determines the relative temperature of pan 122, or fresh food compartment 102 and/or freezer compartment 104. In an exemplary embodiment, fresh food compartment 102 is maintained at about 37 degrees Fahrenheit, freezer compartment 104 is maintained at about 0 degree Fahrenheit, and pan 122 is maintained at a temperature selected by the user.

Figure 2:
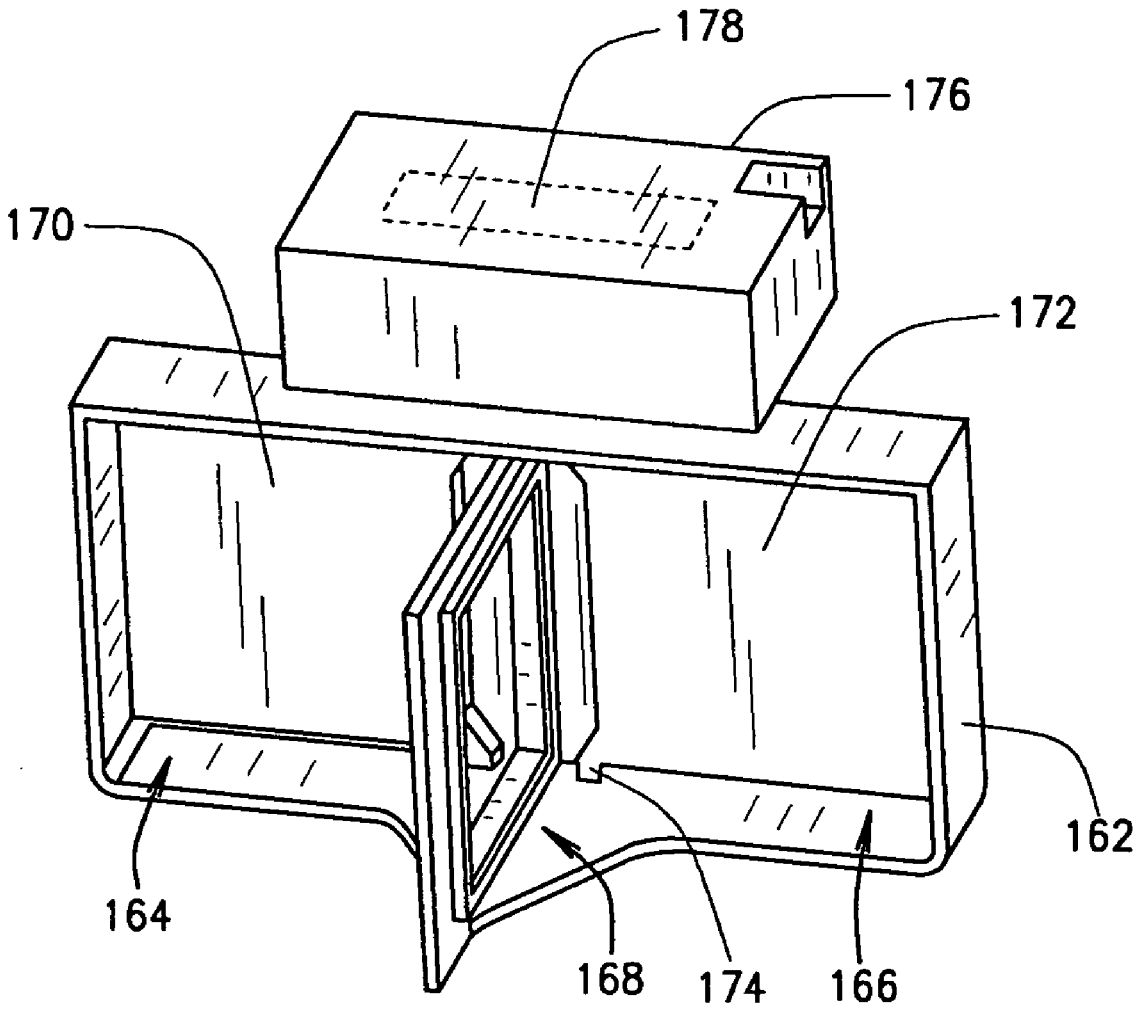
FIG. 2 is a perspective view of an exemplary air flow damper applicable to the refrigerator shown in FIG. 1.

FIG. 2 is a perspective view of an exemplary air flow damper 160 applicable to refrigerator 100 shown in FIG. 1. Damper 160 includes a damper frame 162 defining a first gate 164, a second gate 166, and a third gate 168 thereon. Damper 160 also includes a first damper door 170 and a second damper door 172 rotatably mounted on damper frame 162.

In the exemplary embodiment, gates 164, 166, and 168 are substantially rectangular shaped, and are coupled with the air passages (shown in FIG. 3) formed within refrigerator 100 (shown in FIG. 1) for allowing airflow therethrough. First and second gates 164, 166 are arranged side by side on damper frame 162, and are substantially coplanar. Third gate 168 is substantially perpendicularly positioned with respect to first and second gates 164, 166. It is contemplated, however, that third gate 168 may be positioned at other non-zero angles with respect to first and second gates 164, 166 in alternative embodiments.

In the exemplary embodiment, first and second damper doors 170, 172 are substantially complementarily shapes to, and sized slightly larger than, gates 164, 166, and 168, such that first and second doors 170, 172 may cover a corresponding one of gates 164, 166, and 168, respectively. Each door 170, 172 further includes two pivot members 174 extending therefrom and rotatably received within frame 162, such that doors 170, 172 are rotatably mounted on frame 162. Specifically, first door 170 is rotatable between first and third gates 164, 168, and selectively closes first gate 164 and third gate 168. Second door 172 is rotatable between second and third gates 166, 168, and selectively closes second gate 166 and third gate 168.

In the exemplary embodiment, frame 162 further includes a motor housing 176 mounted on a top portion thereof and receiving a motor 178 therein. In the exemplary embodiment, motor housing 176 is sealed to resist moisture from entering motor housing 176. Condensation on motor 178 is thus reduced. Additionally, freezing or ice accumulation on motor 178 is reduced. Motor 178 is mechanically engaged, such as via a gear, with pivot 174 of each door 170, 172, and drives first and second doors 170, 172 to synchronously rotate on frame 162. Motor 178 is also operatively coupled to the microprocessor (not shown) of refrigerator 100 (shown in FIG. 1), such that motor 178 drives first and second doors 170, 172 to rotate upon receiving a signal from the microprocessor. In the exemplary embodiment, the microprocessor is configured to operate motor 178 to resist ice buildup on each door 170, 172 or on pivot 174. For example, ice may accumulate due to moisture or condensation from the air flow. By operating motor 178, ice that may have accumulated is crushed or eliminated by opening doors 170, 172. The microprocessor operates motor 178 after a predetermined amount of time, such as for example, after motor 178 has been idle for approximately one hour. Alternatively, a sensor (not shown) is provided for sensing condensation or moisture, or for sensing ice accumulation. The sensor transmits a signal to the microprocessor relating to the moisture or ice accumulation, and the microprocessor operates motor 178 based on the signal.

Figure 3:
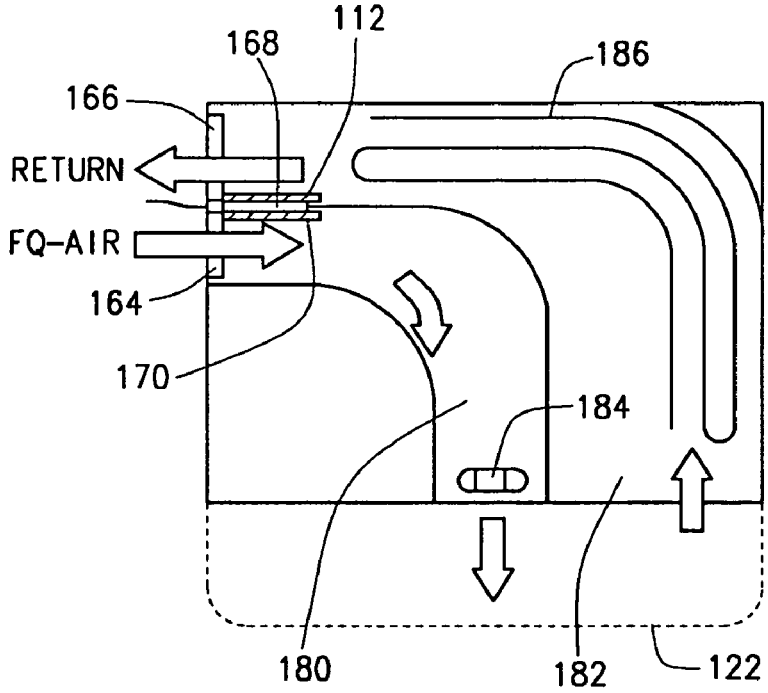
FIG. 3 is a schematic view of the air flow damper shown in FIG. 2 operating in a chill mode.

FIG. 3 is a schematic view of air flow damper 160 shown in FIG. 2 operating in refrigerator 100 (shown in FIG. 1) in the chill mode. FIG. 3 illustrates cool air flowing from freezer compartment 104 (shown in FIG. 1) into pan 122 through damper 160.

In the exemplary embodiment, refrigerator 100 (shown in FIG. 1) further includes an air supply passage 180 and an air return passage 182 coupled in flow communication with pan 122. Air supply passage 180 is coupled in flow communication with damper 160 and first gate 164 of damper 160. Air return passage 182 is also coupled in flow communication with damper 160 and second gate 166 of damper 160. Refrigerator 100 also includes a fan 184 positioned in air supply passage 180 for creating an air flow therethrough, and a heater 186 positioned in air return passage 182 for heating the air flowing therethrough. It is contemplated, however, that fan 184 and heater 186 may be positioned in other places in alternative embodiments, as long as fan 184 and heater 186 are coupled in flow communication with air passages 180, 182. Fan 184 and heater 186 are also operatively coupled to the microprocessor (not shown) of refrigerator 100, and fan 184 and heater 186 may be energized and/or de-energized by the microprocessor.

In the chill mode, first and second doors 170, 172 of damper 160 are rotated inwardly to close third gate 168, and leave first and second gates 164, 166 open. Fan 184 is energized to create airflow through air supply passage 180, and electrical heater 186 is de-energized. As such, cool air is drawn from freezer compartment 104 by fan 184, flows into air supply passage 180 through first gate 164, and then flows into pan 122. A portion of air circulating in pan 122 enters air return passage 182, and then flows back into freezer compartment 104 through second gate 166. First and second doors 170, 172 close third gate 168, and prevent air in air return passage 182 flowing into air supply passage 180 through third gate 168. Thus, cool air from freezer compartment 104 flows into pan 122, and lowers the temperature of pan 122.

Figure 4:
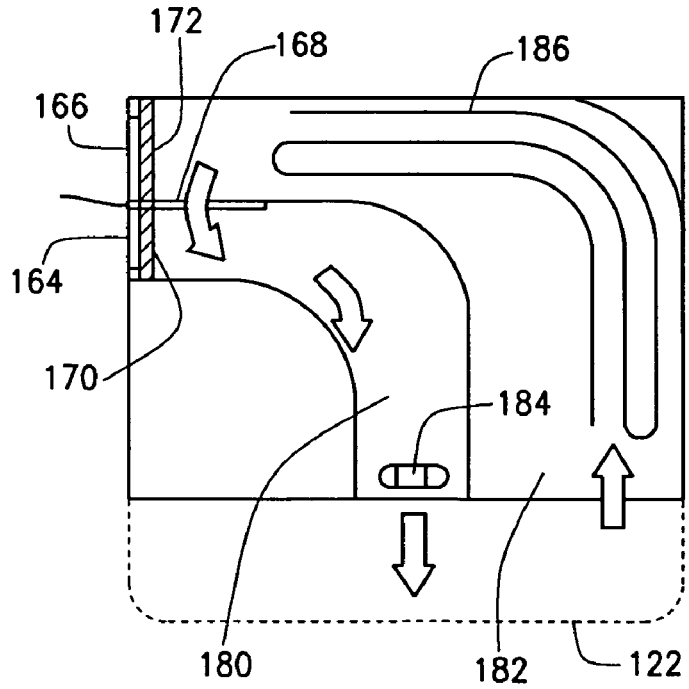
FIG. 4 is a schematic view of the air flow damper shown in FIG. 2 operating in a thaw mode.

FIG. 4 is a schematic view of air flow damper 160 shown in FIG. 2 operating in refrigerator 100 (shown in FIG. 1) in the thaw mode. FIG. 4 illustrates damper 160 creating an inner air circulation path for thawing pan 122.

In the thaw mode, first and second doors 170, 172 of damper 160 are rotated outward to respectively cover first and second gates 164, 166, and leave third gate 168 open. Fan 184 is energized to create airflow through air supply passage 180, and heater 186 may be energized to heat the air flowing therethrough. As such, closed first and second gates 164, 166 block air flowing into and/or out of pan 122, and open third gate 168 maintains air supply passage 180 in flow communication with air return passage 182 therethrough. Air heated by heater 186 is drawn from air return passage 182 into air supply passage 180, and is then drawn into pan 122 by fan 184. A portion of heated air circulating pan 122 then enters air return passage 182. Thus, an inner air circulation path for pan 122 is formed, and the heated air flows along the circulation path to heat pan 122.

In the exemplary embodiment, electrical heater 186 is energized to achieve an air temperature of approximately 40 degrees to 50 degrees Fahrenheit in the thaw mode, such that pan 122 is heated to a temperature independent that of fresh food compartment 102. In one embodiment, heater 186 is energized for a duration of a defrost cycle of selected length, such as a four hour cycle, or an eight hour cycle, or any other cycle selected by the user. In alternative embodiments, heater 186 is used to defrost food and beverage items placed within pan 122 without exceeding a specified surface temperature of the item or items to be defrosted. As such, the items are defrosted or thawed and held in a refrigerated state for storage until the item is retrieved for use. The user therefore need not monitor the thawing process.

When damper 160 is neither in the chill mode nor in the thaw mode, damper 160 reverts to a steady state to maintain pan 122 at a temperature equals to the temperature of fresh food compartment 102, such as 37 degrees Fahrenheit. In an alternative embodiment, damper 160 is utilized to maintain pan 122 at a temperature independent from the temperature of fresh food compartment 102 in the steady state.

With single damper 160 controlling both the cool air flowing into pan 122 and the heated air circulating in pan 122, a combination of a chilling and thawing function is provided in pan 122. As such, within the refrigerator, the system for controlling the damper and the mechanical configuration for accommodating the damper are considerably simplified, which facilitates lowering the cost for designing and assembling the refrigerator.

It is contemplated, however, that cool air flowing through damper 160 may be directly drawn from the evaporator (not shown) instead of freezer compartment 104 (shown in FIG. 1), and that damper 160 may also be employed to control the airflow of fresh food compartment 102, or freezer compartment 104 in alternative embodiments.

While the invention has been described in terms of various specific embodiments, those skilled in the art will recognize that the invention can be practiced with modification within the spirit and scope of the claims.

What is claimed is:

1. A damper for controlling air flow into at least one refrigeration compartment of a refrigerator, said damper comprising:

a damper frame defining a first gate, a second gate, and a third gate thereon; and a first damper door and a second damper door movably mounted on said frame, said first door positionable to selectively close at least one of said first gate and said third gate, said second door positionable to selectively close at least one of said second gate and said third gate;

wherein one of said first gate and said second gate facilitates cool air flowing into the refrigeration compartment when said one of said first gate and said second gate is open, said third gate facilitates air circulation within the refrigeration compartment when said third gate is open.

2. A damper in accordance with claim 1 wherein said first and second doors are configured to move substantially synchronously.

3. A damper in accordance with claim 1 wherein said first and second doors are configured to cover said third gate while leaving said first and second gates open, such that air flows into the refrigeration compartment through said first gate and flows out of the refrigeration compartment through said second gate.

4. A damper in accordance with claim 1 wherein said first and second doors are configured to respectively cover said first and second gates while leaving said third gate open substantially blocking air flow into the refrigeration compartment and creating an air circulation within the refrigeration compartment and through said third gate.

5. A damper in accordance with claim 1 further comprising a motor mounted on said frame and configured to drive said first and second doors to rotate on said frame.

6. A damper in accordance with claim 1 wherein said first and second gates are substantially coplanar, and said third gate is positioned at a non-zero angle with respect to said first and second gates.

7. A refrigerator comprising:

at least one refrigeration compartment; and a damper comprising:

a damper frame defining a first gate, a second gate, and a third gate thereon; and a first damper door and a second damper door movably mounted on said frame, said first door positionable to selectively close at least one of said first gate and said third gate, said second door positionable to selectively close at least one of said second gate and said third gate;

wherein one of said first or second gate facilitates cool air flowing into said refrigeration compartment when one of said first gate and said second gate is open, said third gate facilitates air circulation within said refrigeration compartment when said third gate is open.

8. A refrigerator in accordance with claim 7 further comprising a first air passage coupled with said damper and in flow communication with said first gate, and a second air passage coupled with said damper and in flow communication with said second gate.

9. A refrigerator in accordance with claim 8 wherein said first and second doors are configured to cover said third gate while leaving said first and second gates open, such that air flows into said refrigeration compartment through said first air passage and flows out of the refrigeration compartment from said second air passage.

10. A refrigerator in accordance with claim 7 wherein said first and second doors are configured to respectively cover said first and second gates while leaving said third gate open, substantially blocking air flow into said refrigeration compartment and creating an air circulation within said refrigeration compartment and through said third gate.

11. A refrigerator in accordance with claim 8 wherein said third gate is configured to provide an air flow communication between said first and second air passages when said third gate is open.

12. A refrigerator in accordance with claim 8 wherein said refrigeration compartment further comprises a fan coupled in flow communication with at least one of said first and second air passages, said fan configured to create an air flow through said first and second air passages.

13. A refrigerator in accordance with claim 8 further comprising an electrical heater coupled in flow communication with at least one of said first and second air passages, said heater configured to heat the air circulated within said refrigeration compartment when said third gate is open.

14. A refrigerator in accordance with claim 7 wherein said first gate is substantially coplanar with said second gate, said third gate is substantially perpendicular with respect to said first and second gates.

15. A method for assembling a refrigerator comprising:

providing a refrigeration compartment within the refrigerator; and providing a damper and coupling the damper with the refrigeration compartment, comprising:

providing a damper frame defining a first gate, a second gate, and a third gate thereon, one of the said first and the second gate configured to allow cool air flowing into the refrigeration compartment when the one of the first gate and the second gate is open, the third gate configured to allow air circulation within the refrigeration compartment when the third gate is open; and providing a first damper door and a second damper door movably mounted on the frame, the first door positionable to selectively close at least one of the first gate and the third gate, the second door positionable to selectively close at least one of the second gate and the third gate.

16. A method in accordance with claim 15 further comprising providing a first air passage coupled with the damper and on flow communication with the first gate, and providing a second air passage coupled with the damper and in flow communication with the second gate, the first and second passages coupled in flow communication with the refrigeration compartment.

17. A method in accordance with claim 16 further comprising covering the third gate with the first and second doors while leaving the first and second gates open, such that air flows into the refrigeration compartment through the first air passage and flows out of the refrigeration compartment from the second air passage.

18. A method in accordance with claim 15 further comprising covering the first and second gates while leaving the third gate open, such that air flow is substantially blocked from entering the refrigeration compartment, and an air circulation within the refrigeration compartment and through the third gate is created.

19. A method in accordance with claim 16 further comprising providing a fan coupled in flow communication with at least one of the first and second air passages, the fan configured to create an air flow through the first and second air passages.

20. A method in accordance with claim 15 further comprising providing an electrical heater coupled in flow communication with at least one of the first and second air passages, the heater configured to heat the air circulated within the refrigeration compartment when the third gate is open.

* * * * *

UNITED STATES PATENT AND TRADEMARK OFFICE

CERTIFICATE OF CORRECTION

PATENT NO. : 7,260,957 B2
APPLICATION NO. : 11/297251
DATED : August 28, 2007
INVENTOR(S) : Kalyanavaradhan et al.

It is certified that error appears in the above-identified patent and that said Letters Patent is hereby corrected as shown below:

Title Page, Item (75) Inventors:
In the Inventors, delete "Maheesh" and insert therefor --Mahesh--.

Signed and Sealed this

Tenth Day of June, 2008

JON W. DUDAS
*Director of the United States Patent and Trademark Office*